US011828093B1

(12) United States Patent
Russo

(10) Patent No.: US 11,828,093 B1
(45) Date of Patent: Nov. 28, 2023

(54) PAINTER DOOR CHOCK

(71) Applicant: Erik Russo, Marlton, NJ (US)

(72) Inventor: Erik Russo, Marlton, NJ (US)

( * ) Notice: Subject to any disclaimer, the term of this patent is extended or adjusted under 35 U.S.C. 154(b) by 82 days.

(21) Appl. No.: 17/732,188

(22) Filed: Apr. 28, 2022

(51) Int. Cl.
*E05C 17/54* (2006.01)

(52) U.S. Cl.
CPC ..... *E05C 17/54* (2013.01)

(58) Field of Classification Search
CPC ..... E05C 17/54; B60T 3/00
USPC ..... 292/258, 343, 288, 342; D8/402
See application file for complete search history.

(56) References Cited

U.S. PATENT DOCUMENTS 535,507 A * 3/1895 McGrory ..... E05C 17/54 292/343
701,136 A * 5/1902 Blanpied ..... E05C 19/18 292/288
771,753 A * 10/1904 Stanley ..... B25B 11/00 269/133
786,831 A * 4/1905 McMahon ..... E05C 17/54 292/343
816,757 A * 4/1906 Squier ..... E05C 17/54 292/343
934,747 A * 9/1909 McNaughton ..... E05C 17/54 292/344
1,064,760 A * 6/1913 Nielsen ..... E05C 19/18 292/288
1,664,174 A * 3/1928 Hoopes, Jr. ..... E05C 17/54 292/288
1,762,095 A 6/1930 Houston
1,876,881 A * 9/1932 Durant ..... E05C 17/54 292/288
2,011,469 A * 8/1935 Brueggemann ..... B60T 3/00 188/32
2,120,692 A * 6/1938 Butts ..... E05C 17/54 16/86 A
2,172,610 A * 9/1939 Frank ..... E05C 17/54 16/86 A
2,703,728 A * 3/1955 Raber ..... E05C 17/54 292/288
2,773,564 A * 12/1956 Garard ..... B60T 3/00 D12/217
3,280,943 A * 10/1966 Luiz ..... B60T 3/00 188/32
3,328,065 A * 6/1967 Arenson ..... E05C 17/54 16/86 A
4,017,939 A * 4/1977 Schofield ..... B32B 15/08 292/343
4,705,309 A 11/1987 Sawchuk
D420,570 S * 2/2000 Johnson ..... D8/402
8,118,180 B2 * 2/2012 Van Belkom ..... B60T 3/00 211/59.3

(Continued)

*Primary Examiner* — Jeffrey O'Brien
(74) *Attorney, Agent, or Firm* — Goldstein Law Offices, P.C.

(57) ABSTRACT

A door chock device, including: a connecting rod having two ends and two sides; and a first and second wedge, slideably attached to opposites sides of the connecting rod through a hinge bracket attached near the long base of each wedge, the first and second wedges have opposing slopes adapted to secure a portion of a base of a hinged man-door between the first and second wedge when the first and second wedge slide toward each other. Also disclosed is a method of applying a coating to a hung hinged man-door using the man-door chock device.

8 Claims, 6 Drawing Sheets

(56) References Cited

U.S. PATENT DOCUMENTS

| | | | | |
|---|---|---|---|---|
| 8,365,355 | B2 * | 2/2013 | Liu | E05C 17/54 16/82 |
| 9,074,395 | B2 * | 7/2015 | Packer | E05C 19/182 |
| 9,074,396 | B2 * | 7/2015 | Packer | E05C 19/182 |
| 9,644,407 | B1 | 5/2017 | Abramovits | |
| 2005/0235561 | A1 * | 10/2005 | Bushey | E05C 17/54 49/70 |
| 2014/0312634 | A1 * | 10/2014 | Cushwa, Jr. | E06B 9/02 292/340 |
| 2015/0240541 | A1 * | 8/2015 | Tellarini | E05C 17/54 16/82 |
| 2018/0128027 | A1 | 5/2018 | Seamans et al. | |
| 2023/0029104 | A1 * | 1/2023 | Hu | B60T 3/00 |

* cited by examiner

PAINTER DOOR CHOCK

CROSS-REFERENCE TO RELATED APPLICATIONS

This application is a nonprovisional utility application having no priority applications or priority claims.

TECHNICAL FIELD

The present disclosure relates generally to a device to assist a painter while painting. More particularly, the present disclosure relates to a device that assists a painter while painting a door.

BACKGROUND

Painting a hinged or swinging man-door can present challenges. When the door is closed the gaps between the door jam, and the door jam trim may need to be protected, e.g., with painter tape. When the hinged door is open it can erratically swivel on the hinge when contacted with a force such as a paintbrush, a paint roller, pressurized paint sprayer, or a gust of air. Restricting the door's swivel movement with, for example, a conventional rubber door stopper is unsatisfactory when painting both sides of the door since the stopper restricts only one swivel direction. The present disclosure provides a device that avoids these challenges.

In the present disclosure, where a document, act, or item of knowledge, is referred to or discussed, this reference or discussion is not an admission that the document, act, or item of knowledge, or any combination thereof, was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

The present disclosure provides a door chock device, comprising: a connecting rod having two ends and two sides; and a first wedge and a second wedge, wherein each wedge has a short leg, a long base, and a sloped hypotenuse, each wedge is slidably attached to the connecting rod through a hinge bracket attached to the wedge near the long base, the first wedge is on the first side of the connecting rod and a second wedge is on the second side of the connecting rod when the wedges are located upon a floor surface or positioned ready for use, the first wedge and the second wedge have opposing slopes adapted to secure a portion of a base of a hinged man-door between the first wedge and the second wedge when the first wedge and the second wedge slide toward each other.

The present disclosure also provides a method of applying a coating to a hung hinged man-door, comprising: engaging at least one of the abovementioned door chock devices with the base of a hung hinged man-door in an open position; and applying a coating to at least one of the facial surfaces of the door.

The present disclosure addresses at least one of the foregoing challenges. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1:
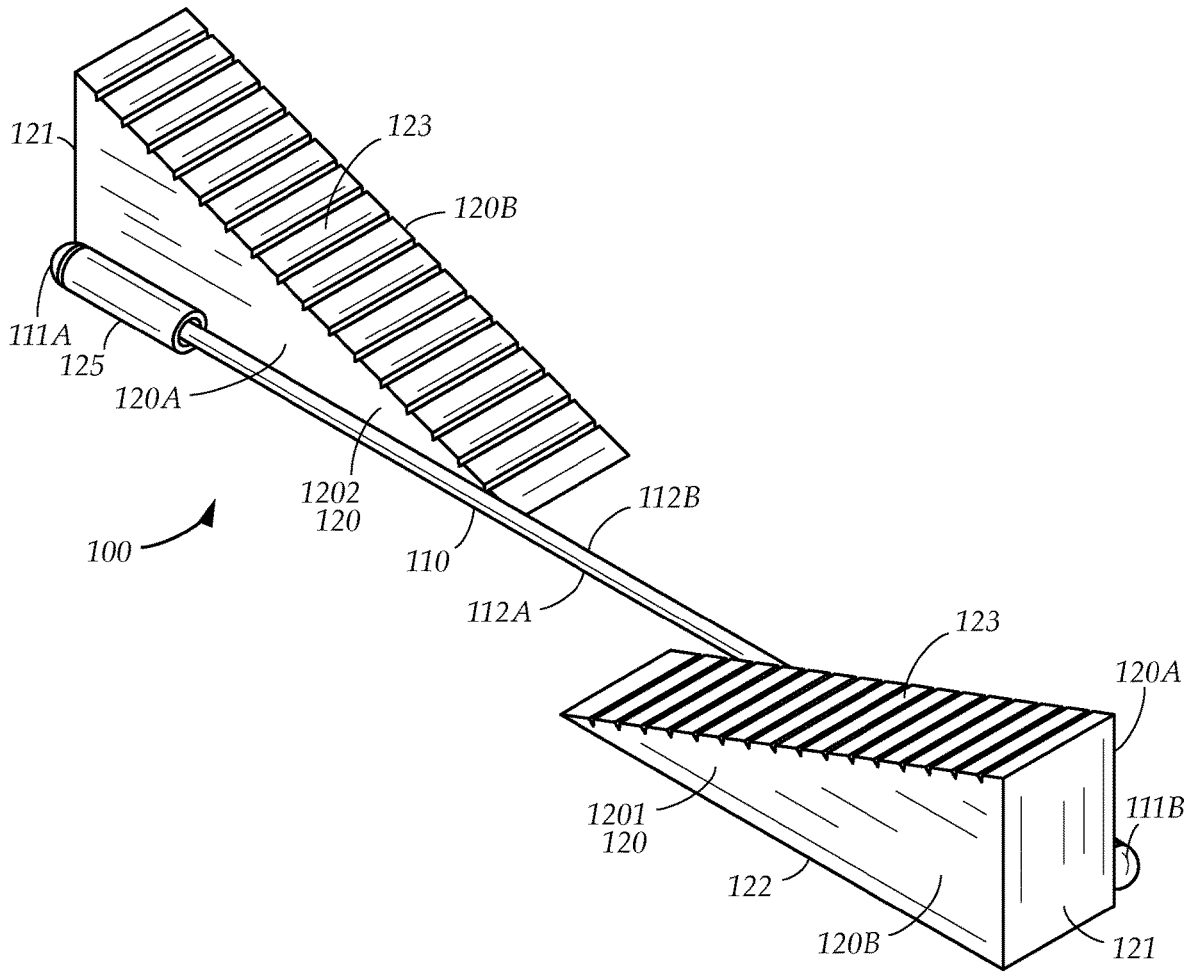
FIG. 1 is a perspective view of an inventive door chock device having a pair of wedges attached by a connecting rod.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

The present disclosure provides a door chock device, comprising: a connecting rod having two ends and two sides; and a first wedge and a second wedge, wherein each wedge has a short leg, a long base, and a sloped hypotenuse, each wedge is slidably attached to the connecting rod through a hinge bracket attached to the wedge, when in use upon a floor surface, the first wedge is on the first side of the connecting rod and a second wedge is on the second side of the connecting rod, the first wedge and the second wedge have opposing slopes adapted to secure a portion of a base of a hinged man-door between the first wedge and the second wedge when the first wedge and the second wedge are slid toward each other. That is, the opposing slopes are oriented such that the sloped hypotenuse of the first wedge is negative and faces the second wedge, and the sloped hypotenuse of the second wedge is positive and faces the second wedge.

In embodiments, the slope of either the first wedge or the second wedge can be, for example, from 10 to 50 degrees, from 20 to 40 degrees, from 25 to 35 degrees, and preferably from 27 to 33 degrees such as 30 degrees, including intermediate values and ranges.

In embodiments, the door chock device can further comprise, for example, a bend angle on at least one end of the connecting rod. A single bend angle (i.e., bent end) connecting rod can serve as a slideable stop for one or both of the first and second wedges, an unbent opposite rod end allows both wedges to be removed from the rod for cleaning or maintenance of the device. A bent angle on both ends of the connecting rod stops the first and second wedges, and slidably secures the wedges to the rod.

In embodiments, the door chock device can further comprise, for example, screw threads and a nut fastener on at least one end of the connecting rod. A screw threaded and nuted fastener on one end of the rod can serve as a slideable stop for one or both of the first and second wedges with respect to the fastened end. A threaded and nuted fastener on both ends of the rod stops the first and second wedges in both directions and slideably secures the wedges to the rod with respect to both fastened ends. A screw threaded and nuted fastener on the rod ends provides advantages for, for example, manufacturing, repairs, rod height adjustment, disassembly, and cleaning.

In embodiments, the nut fastener can be, for example, at least one interchangeable sphere having a diameter larger than the diameter of the connecting rod that can be used to adjust the elevation height of the rod above a floor surface when in use, i.e., the diameter of the sphere or like nut fastener on each end of the rod can be selected to allow the wedges to correctly engage the base of the hung hinged man-door. The diameter of the sphere or like configured and sized nut fastener can be used as a supplement to the elevation height adjustment provided by the opposing slopes of the wedges.

In embodiments, the door chock device can further comprise at least one anti-slip surface on at least one working surface of the first and second wedges. The anti-slip surface, i.e., a "working surface" or "contact surface", can be, for example, on at least one of the sloped hypotenuses, on at least one of the long bases, or both. In contrast, the short leg of the wedge is a non-contact surface.

In embodiments, the at least one anti-slip surface on at least one of the first and second wedges is at least one of: one or more corrugated ridges cut into the surface, a compressible rubber strip or plastic strip affixed to a working surface of a wedge, or a vulcanized non-slip rubber strip. The corrugated ridges can be, for example, ribs, slots, notches, pimples, bumps, and like structures that interrupt a smooth surface and enhance door or floor grip and reduce slip.

In embodiments, the door chock device can further comprise, for example, a resilient stretchable member coaxially mounted on the connecting rod and attached to at least one of the first wedge and the second wedge, e.g., an expandable and compressible spring or an elastic band that creates a tension force between the wedges that aids in keeping one or both of the wedges engaged with the bottom of the door while its being coated such as with paint, stain, sealer, and like coats.

In embodiments, the first wedge and the second wedge can be constructed, for example, of at least one suitable wood, metal, plastic, glass, composite, and like material, or combinations thereof, and the rod can be constructed, for example, of at least one of wood, metal, plastic, glass, composite, and like material, or combinations thereof. Similarly, associated hardware such as hinge brackets and rod end hardware can be constructed compatible materials, for example, of at least one of wood, metal, plastic, glass, composite, and like material, or combinations thereof.

The present disclosure also provides a method of applying a coating (e.g., painting, staining, or varnishing) to a hung hinged man-door, comprising: engaging an inventive door chock device with the hung hinged door in an open position; and applying a coating to at least one of the accessible surfaces of the door, e.g., one of the facial surfaces or optionally a vertical or horizontal edges of the door.

Referring to the Figures, FIG. 1 illustrates a perspective view of a door chock device 100 having a connecting rod 110 having two opposite ends 111A and 111B (shown here with optional threaded fasteners obscuring actual ends) and two opposite sides 112A and 112B; a pair of wedges 120 including a first wedge 1201 and a second wedge 1202 situated on the opposite sides of the connecting rod 110. Each wedge 120 is substantially triangular in cross section having a short leg 121, a long base 122, and a sloped hypotenuse 123 that together define said triangular shape, and also has an inner side surface 120A and an outer side surface 120B. Each wedge has a hinge bracket 125 rigidly attached to the inner side surface 120A adjacent to the long base 122.

Figure 2:
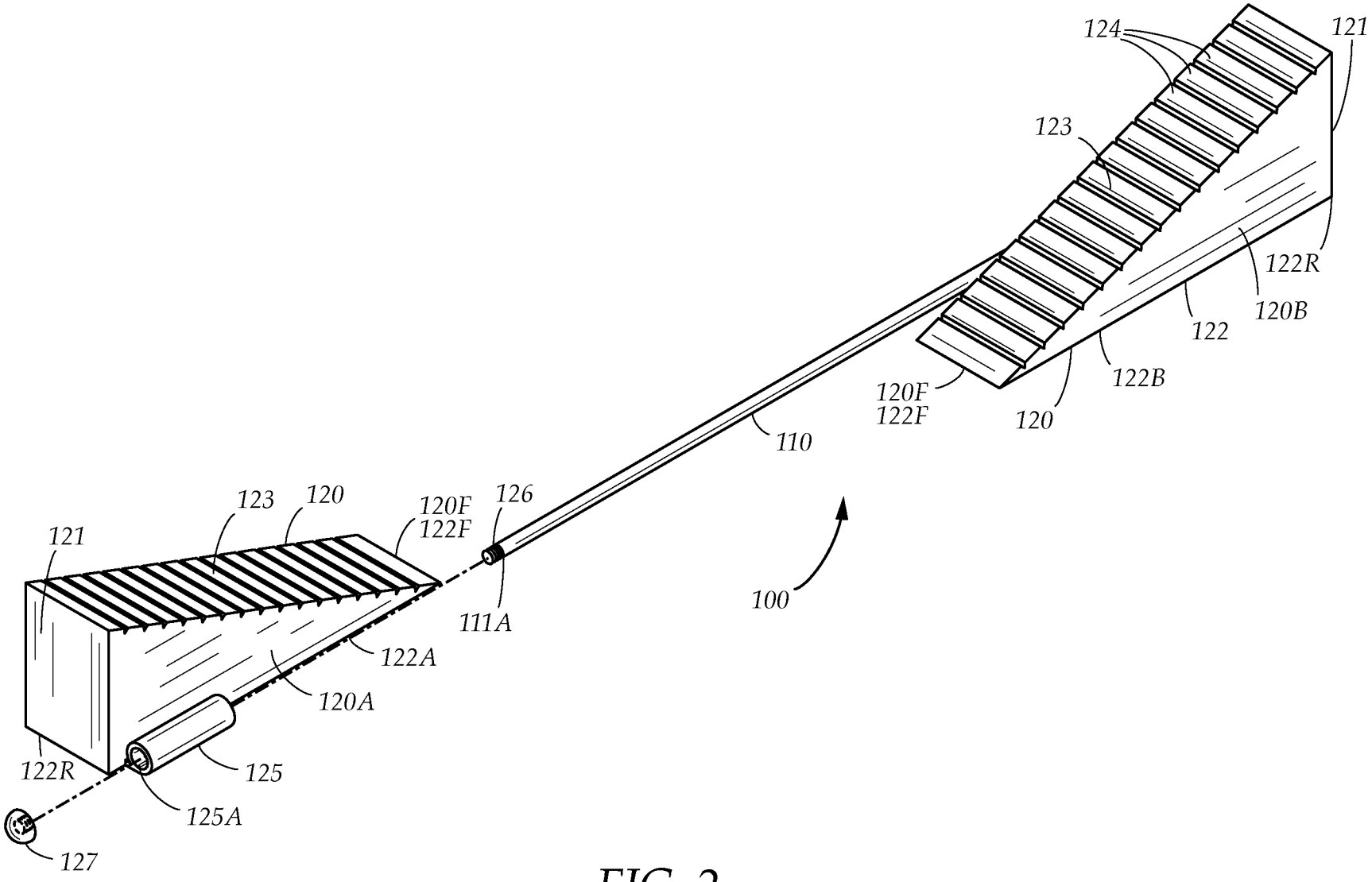
FIG. 2 is a partially exploded perspective view 200 of FIG. 1 showing attachment of one of the wedges by extending the connecting rod axially through a collar attached to that wedge.

FIG. 2 is a partially exploded perspective view of the door chock device 100 that shows and calls out additional features and details of the exemplary chock device. Each of the wedges 120 has a front edge 120F where the long base 122 meets the sloped hypotenuse 123. The long base 122 has a front 122F at the front edge 120F, a rear 122R, an inner edge 122A, and an outer edge 122B. The short leg 121 extends vertically upwardly at the rear 122R of the long base 122. The inner side surface 120A extends from the front edge 120F to the short leg 121 and extends vertically between the long base 122 and the hypotenuse 123. The outer side surface 120B extends from the front edge 120F to the short leg 121 and extends vertically between the long base 122 and the hypotenuse 123. The hypotenuse 123 has a surface that can optionally have a plurality of treads 124, steps, serrations, or like affirmative gripping modifications, to enhance the engagement of the chock device to the bottom edge of a man-door, see FIGS. 3 to 6. As mentioned briefly in describing FIG. 1, each wedge is slideably attached to the connecting rod 110 through one of the hinge brackets 125 situated on and attached to the inner side surface 120A near the long base 122. In particular, the hinge bracket 125 may be defined as a tube or collar, with a longitudinally extending bore 125A that is larger in diameter than the connecting rod such that the connecting rod 110 extends through the longitudinally extending bore 125A to allow the wedge 120 to slide longitudinally along the connecting rod 110. The hinge bracket 125, and the longitudinally extending bore 125A, preferably extends substantially parallel to the long base 122. To maintain the wedges 120 on the connecting rod 110 as the bracket or to limit the travel of the wedges on the connecting rod 110 from extending past the ends 111A (or 111B, not shown), the connecting rod 110 can have a limit stop that may be configured as a threaded end 126 and a threaded fastener 127 that can be attached to said threaded end 126. The fastener 127 would be larger in diameter than the longitudinally extending bore 125A of the bracket 125, and may be a hemispheric shaped nut.

Figure 3:
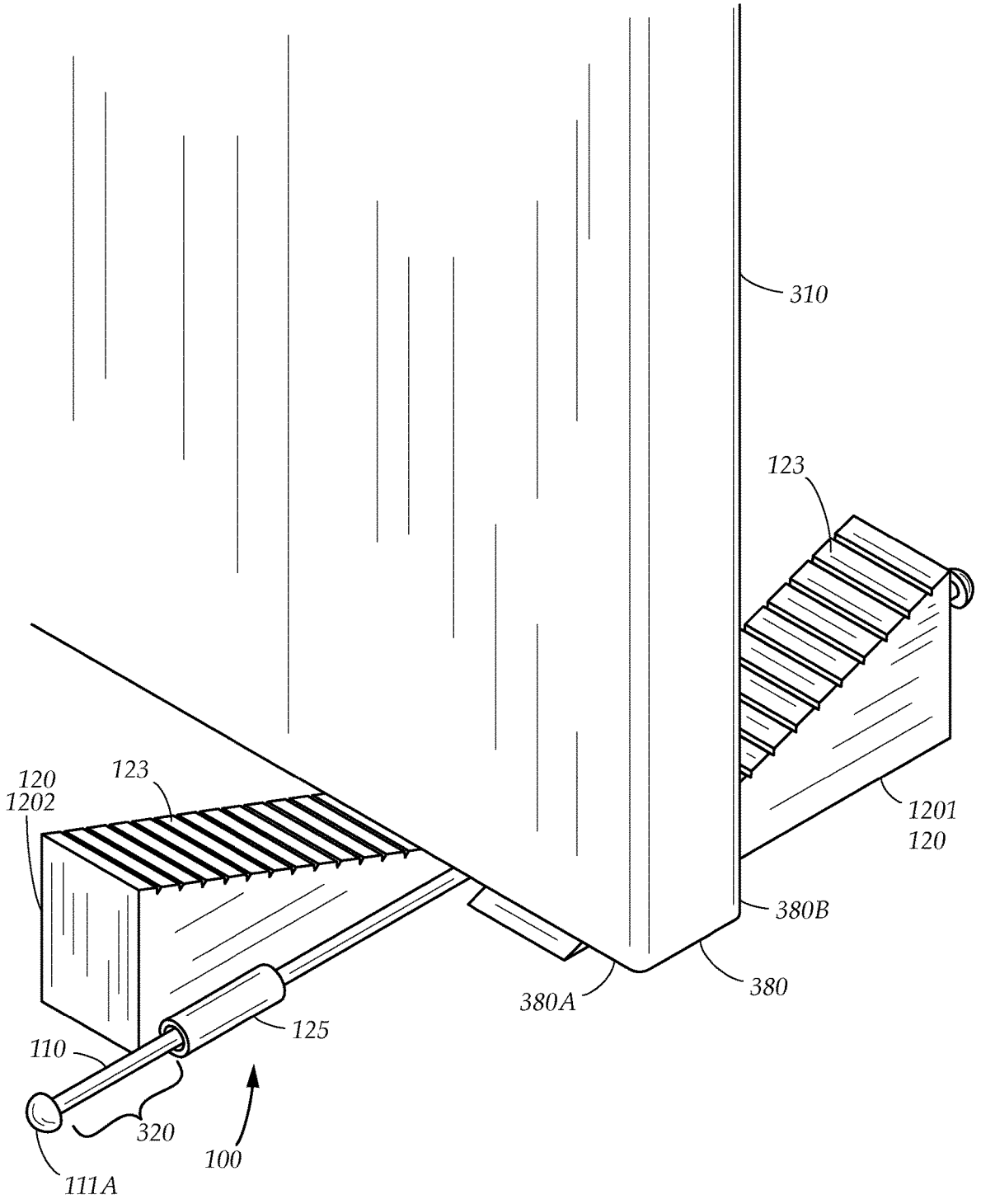
FIG. 3 is a perspective view of the door chock device of FIG. 1 engaging a man-door.

FIG. 3 is a perspective view, showing the door chock device 100 in use, engaging a man-door 310. The man-door 310 has a base 380 having a pair of opposite base edges 380A, 380B. The hypotenuses 123 of the first wedge 1201 and the second wedge 1202 have opposing slopes adapted to engage the base 380 near the opposite base edges 380A, 380B, to immobilize the hinged man-door 310 between the first wedge 1201 and the second wedge 1202 when the first wedge 1201 and the second wedge 1202 are slid or urged toward each other along the connecting rod 110. Also revealed is a slideable compression region or gap 320 between the bracket 125 and one of the connecting rod ends 111A that increases as the wedge 120 is slid toward the man-door 310.

Figure 4:
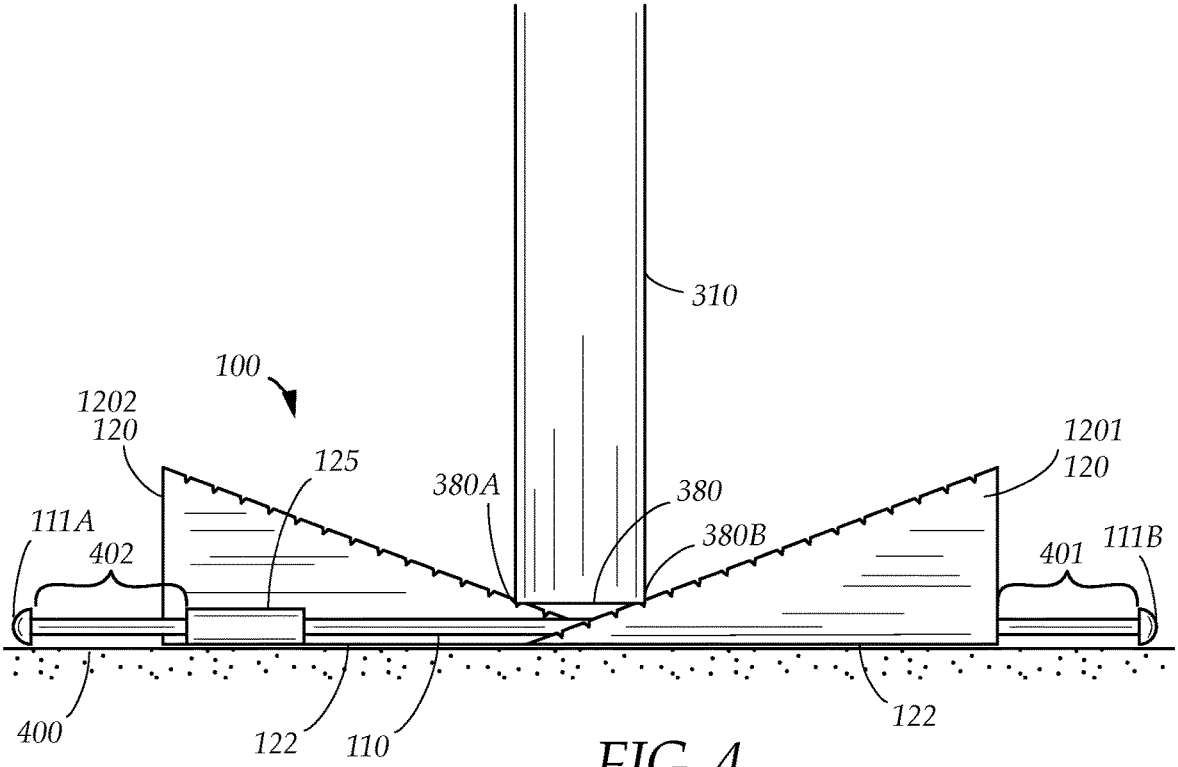
FIG. 4 is a side elevation view of the chock device of FIG. 1 engaging the base of a man-door near the front and rear bottom edges of the door.

FIG. 4 is an elevation view of the door chock device 100 upon a floor surface 400 and engaging the base 380 of the man-door 310 near the edges 380A, 380B. To engage the assembly 100, the first and second wedges 1201, 1202 are separated and slid toward opposite ends 111A, 111B of the connecting rod 110. Then the "open" rod portion (between the spread wedges 120) is slid beneath the door base 380. Next, both the first and second wedges 1201, 1202 are slid toward the other along the connecting rod 110 to snug both wedges 1201, 1202 on the edges 380A, 380B of the door base 380. When both wedges 1201, 1202 are slid toward the other along the rod 110, both ends of the rod 110 generate a first slideable compression gap 401 and a second slideable compression gap 402 between the respective hinge bracket 125 and rod end 111A, 111B.

Figure 5:
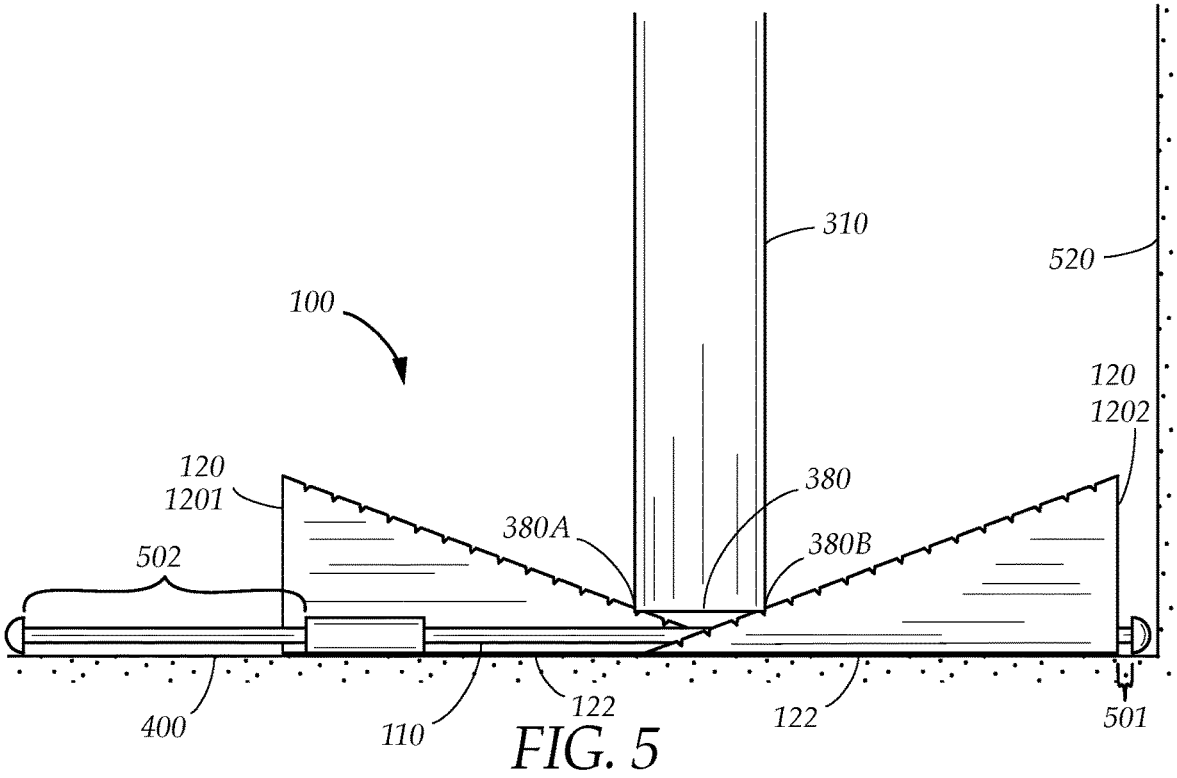
FIG. 5 is an alternate elevation view of the door chock device described in FIG. 4 additionally accommodating chock operation in the presence of an obstacle or obstruction.

FIG. 5 is an alternative elevation view of the door chock device 100 in use upon a floor surface 400, additionally accommodating the presence of an obstacle or obstruction 520. The device 100 is engaged with the man-door 310 near the base edges 380A, 380B of the base 380 of the door, but the positioning of the connecting rod 110 is further limited by a structural obstruction 520, such as another door, a wall, plumbing, or conduit. In this instance, the second wedge 1202 generates a wider compression gap 502 while first wedge 1201 generates a narrower compression gap 501 due to the obstruction 520.

Figure 6:
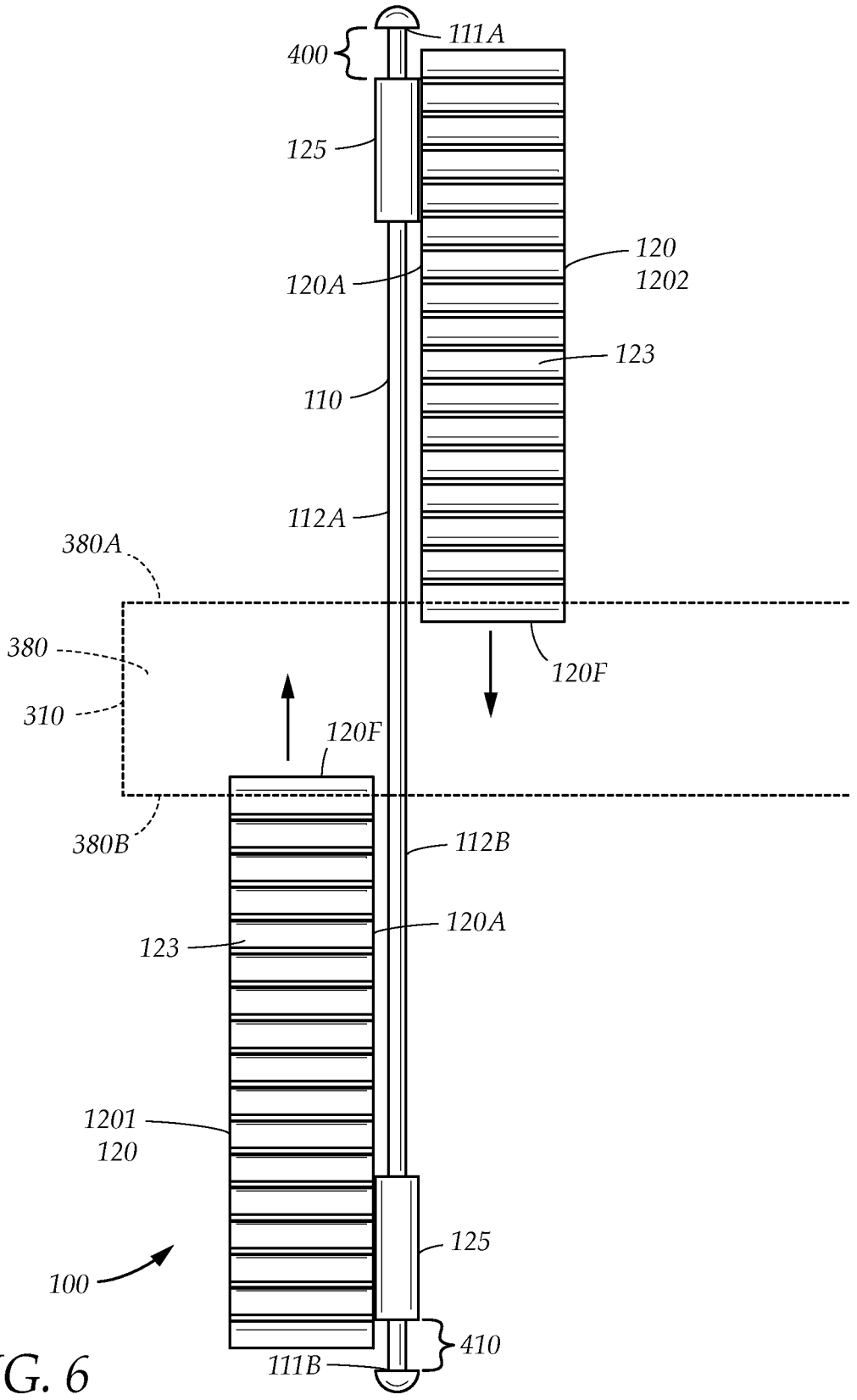
FIG. 6 is a top plan view of the door chock device, showing engagement of the device with a door and the parallel arrangement of the wedges and connecting rod extending therebetween.

FIG. 6 is a top plan view of the door chock device. Here the chock device 100 has engaged the man-door 310 near the base edges 380A, 380B on the base 380 of the door generating comparable compression gaps 400 and 410 between the respective connected rod ends 111A, 111B, and the slideable brackets 125 along the connecting rod 110 resulting from positive compression force and movement (see opposing arrows) of the first and second wedges toward the other. Also note that the inner side surface 120A of the first wedge 1201 is on the first side 112A of the connecting rod 110 and the inner side surface 120A of the second wedge 1202 is on the second side of the connecting rod and the wedges 120 are substantially parallel to each other. This is the case when the long bases 122 of both wedges 120 are substantially parallel and co-planar, (as seen in FIG. 4 and FIG. 5). With the connecting rod 110 extending between the wedges 120, the wedges 120 can slide longitudinally along the connecting rod 110 to move the front edges 120F toward and away from each other while the inner side 120A surfaces of the wedges 120 remain substantially parallel, so that when the long bases are positioned upon the floor surface 400 (see FIG. 4 and FIG. 5), the hypotenuses 123 are adapted to engage the base 380 of a hinged man-door adjacent to opposite base edges 380A, 380B to immobilize the man-door 310.

Figure 7:
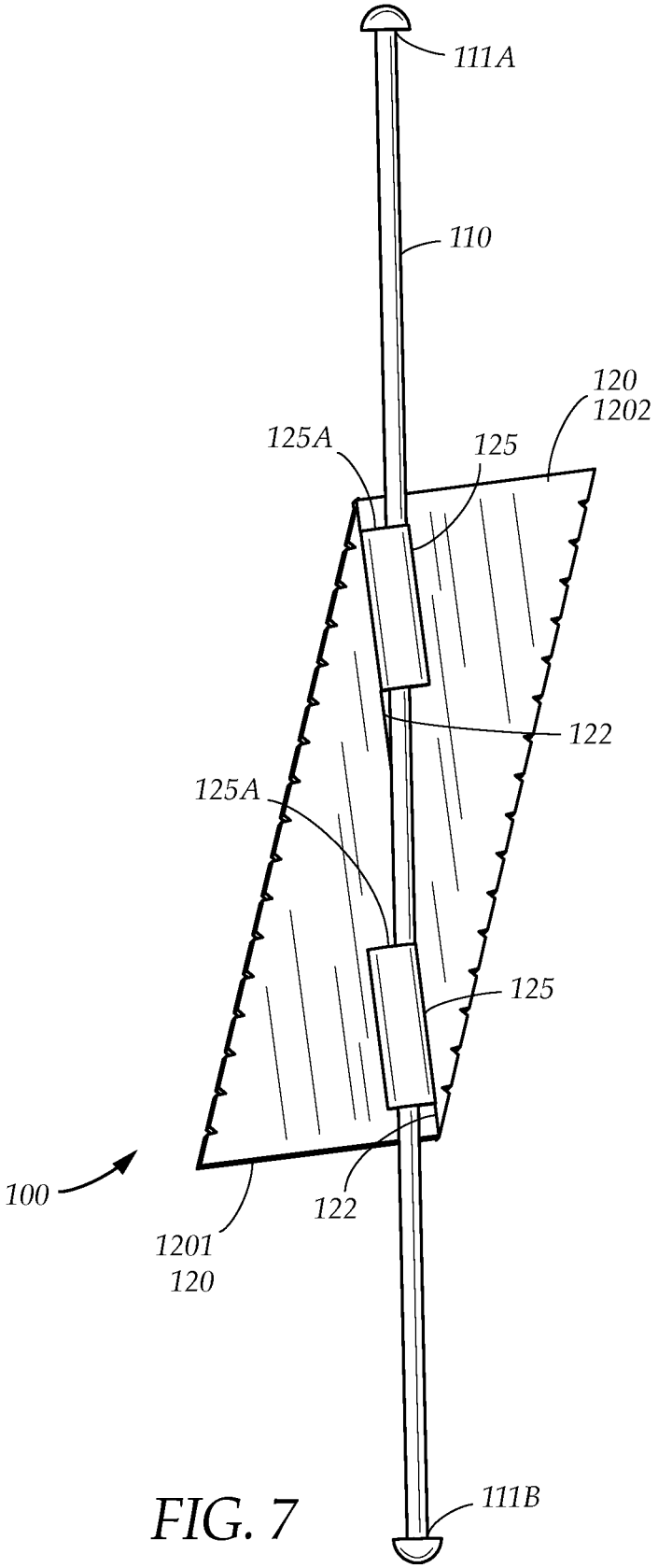
FIG. 7 is a top plan view 700 of the door chock device in an alternative position wherein the wedges have been slid and pivoted upon the connecting rod into a collapsed configuration.

FIG. 7 is an alternative top plan view of the door chock device 100, now shown in a disengaged and collapsed configuration. One or both of the first 1201 and second 1202 wedges can be rotated and slid on the rod 110 to form the apparent trapezoid from mating or matching up the long bases 122 of the wedges 120. The illustrated disengaged and collapsed configuration of FIG. 7 can be useful for storing (e.g., in a tool box or paint box) or for packaging (e.g., a reduced footprint for a hanger package). Alternatively, the collapsed trapezoid of wedges 120 can be positioned anywhere along the length of the connecting rod 110 and between the opposite ends 111A, 111B of the rod 110. Note that the positioning of the wedges 120 into this configuration with the long bases 122 against each other is facilitated by having the longitudinally extending bore 125A of each of the hinge brackets 125 being significantly greater in diameter than the connecting rod 110, to provide sufficient 'play' for the rod to extend diagonally across the longitudinally extending bore, as illustrated in FIG. 7.

In embodiments, the ends of the connecting rod can have screw threads and a threaded nut fastener on at least one end of the connecting rod.

In embodiments, the components of the door chock device can be constructed from, for example, any suitable wood, metal, plastic, fiberglass, composite, and like materials, or combinations thereof.

In embodiments, the ends of the connection rods can have, for example, a bend angle such as about 90 degrees to create a "stop" point on one or both of the ends of the rod instead of a threaded end and a threaded fastener combination.

In embodiments, the ends of the connection rods can have, for example, an interchangeable sphere (not shown in the FIGS) having a diameter larger than the diameter of the connecting rod. The interchangeable sphere having a threaded fastener hole can provide a fastener fixing and stop function. The interchangeable sphere can also provide a vertical height spacing function, for example, if the man-door is unusually low or high relative to the floor surface.

In embodiments, either or both of the first wedge and second wedge can additionally have an anti-slip surface modification on at least one working surface. The anti-slip surface modification on the base surface of the wedge can assist bottom surface (i.e., wedge-to-floor) gripping or prevents the wedge from slipping out of position with respect to the man-door. The anti-slip surface modification on the hypotenuse surface assists the hypotenuse surface in gripping and holding the man-door between the wedges when engaged.

In embodiments, the inventive door chock can further include a resilient stretchable member that can be coaxially mounted on or near the connecting rod and attached to one or both of the wedges. The resilient stretchable member can draw one or both of the opposing wedges toward the other and ensure secure contact with the base of the door. The resilient stretchable member can be, for example, a spring, an elastic (e.g., a rubber band or a bungee), and like resilient members, or a combination thereof.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, the disclosure presented a man-door chock device and a method of applying a coating to a hung hinged man-door using the door chock device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A door chock device, for use upon a floor surface for selectively immobilizing a man-door having a base having a pair of opposite base edges that are located near the floor surface, comprising:

a connecting rod having two ends, a first side, and a second side; and a first wedge and a second wedge, each wedge triangular in shape wherein each wedge has a short leg, a front edge, a long base having a front, a rear, an inner edge and an outer edge, the front edge at the front of the long base, the short leg extending upwardly at the rear, each wedge also having a sloped hypotenuse extending between the front edge and the short leg, an inner side surface from the front edge to the short leg and extending vertically between the long base and the hypotenuse, and an outer side surface from the front edge to the short leg and extending vertically between the long base and the hypotenuse, each wedge also having a hinge bracket extending along the inner side surface adjacent to the long base; and wherein each wedge is slideably attached to the connecting rod by the connecting rod extending through the respective hinge bracket such that when the long bases of the wedges are co-planar, the inner side surface of the first wedge is on the first side of the connecting rod and the inner side surface of the second wedge is on the second side of the connecting rod and the wedges are parallel to each other and to the connecting rod extending between the wedges, the wedges are configured to slide longitudinally along the connecting rod to move the front edges toward and away from each other while the inner side surfaces of the wedges remain parallel, so that the when the long bases are positioned upon a floor surface, the hypotenuses are adapted to engage the base of a hinged man-door adjacent to opposite base edges to maintain the position of the man-door.

2. The door chock device of claim 1, wherein the slope of either the first wedge or the second wedge is between 10 and 50 degrees.

3. The door chock device of claim 2, wherein each hinge bracket has a longitudinally extending bore that is parallel to the long base by the connecting rod extending through the longitudinally extending bore, the connecting rod further comprising a limit stop located at each end of the connecting rod.

4. The door chock device of claim 3, wherein at least one end of the connecting rod has screw threads and the limit stop includes a nut fastener secured to the screw threads of the connecting rod.

5. The door chock device of claim 4, further comprising at least one anti-slip surface on at least one working surface of either or both the first and the second wedge.

6. The door chock device of claim 5, wherein the at least one anti-slip surface on at least one of the first and second wedges is at least one of: one or more corrugated ridges, a compressible rubber strip or plastic strip affixed to a surface of a wedge, and a vulcanized non-slip rubber strip.

7. The door chock device of claim 6, wherein the first wedge and the second wedge, the rod, and the brackets, are constructed of at least one of wood, metal, plastic, glass, and composite.

8. A method of applying a coating to a hung hinged man-door, using the door chock device of claim 1, comprising:

engaging a base of a hung hinged man-door in an open position with the door chock device;

applying a coating to at least one of the accessible surfaces of the door;

removing the door chock device from the base of the man door;

pivoting the wedges of the door chock device into a storage position by positioning the long base of the wedges against each other by rotating the wedges around the connecting rod.

* * * * *